US006952849B2

(12) United States Patent
Pacella

(10) Patent No.: US 6,952,849 B2
(45) Date of Patent: Oct. 11, 2005

(54) ORGANIZER FOR A PLAYARD

(75) Inventor: Jonathan M. Pacella, Coatesville, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/396,714

(22) Filed: Mar. 26, 2003

(65) Prior Publication Data

US 2004/0187212 A1 Sep. 30, 2004

(51) Int. Cl.[7] ..... A47D 15/00
(52) U.S. Cl. ..... 5/658; 5/503.1; 5/93.1
(58) Field of Search ..... 5/93.1, 93.2, 98.1, 5/99.1, 503.1, 658, 663, 507.1, 947; 248/95, 97; 108/49

(56) References Cited

U.S. PATENT DOCUMENTS

| | | | | | |
|---|---|---|---|---|---|
| 1,577,298 | A | | 3/1926 | Roeller | |
| 2,290,099 | A | | 7/1942 | Gill | |
| 2,455,119 | A | | 11/1948 | Hall | |
| 2,546,790 | A | | 3/1951 | Shook | |
| 2,557,556 | A | | 6/1951 | Morris | |
| 2,577,579 | A | | 12/1951 | Hall | |
| 2,608,696 | A | | 9/1952 | Le Roy | |
| 2,635,797 | A | | 4/1953 | Siebert | |
| 3,400,829 | A | * | 9/1968 | Youngson | 211/119.6 |
| 3,489,194 | A | | 1/1970 | Hoover | |
| 4,010,880 | A | | 3/1977 | Guillot-Munoz | |
| 4,154,323 | A | | 5/1979 | Sneider | |
| 4,186,859 | A | | 2/1980 | Frankfort et al. | |
| 4,466,659 | A | * | 8/1984 | Carpentier et al. | 297/188.06 |
| 4,566,130 | A | | 1/1986 | Coates | |
| 4,694,503 | A | | 9/1987 | Hydorn | |
| 4,781,277 | A | | 11/1988 | Lim | |
| 4,830,238 | A | | 5/1989 | Widinski et al. | |
| 4,856,744 | A | | 8/1989 | Frankel | |
| 5,050,742 | A | | 9/1991 | Muckenfuhs | |
| 5,377,837 | A | | 1/1995 | Roussel | |
| 5,439,154 | A | | 8/1995 | Delligatti | |
| 5,490,623 | A | | 2/1996 | McConnell | |
| 5,651,152 | A | * | 7/1997 | Ritchie et al. | 5/503.1 |
| 5,699,564 | A | * | 12/1997 | Heh | 5/503.1 |
| 5,702,038 | A | | 12/1997 | Miller et al. | |
| 5,743,649 | A | | 4/1998 | Gonzalez | |
| 5,813,064 | A | * | 9/1998 | Hartenstine | 5/99.1 |
| 5,855,412 | A | | 1/1999 | Smith et al. | |
| 5,867,850 | A | * | 2/1999 | Mariol | 5/93.2 |
| 5,868,227 | A | | 2/1999 | Garcia | |
| 5,957,585 | A | | 9/1999 | Dabrowski | |
| 5,961,216 | A | | 10/1999 | Quinn et al. | |
| 6,030,010 | A | | 2/2000 | Graeff | |
| D429,929 | S | | 8/2000 | Benson | |
| 6,168,022 | B1 | | 1/2001 | Ward et al. | |
| 6,192,535 | B1 | * | 2/2001 | Warner et al. | 5/93.1 |
| 6,298,993 | B1 | | 10/2001 | Kalozdi | |
| 6,658,678 | B2 | * | 12/2003 | Hotaling et al. | 5/503.1 |
| 6,687,927 | B1 | * | 2/2004 | Tharalson et al. | 5/98.1 |

* cited by examiner

*Primary Examiner*—Michael Trettel
(74) *Attorney, Agent, or Firm*—Foley & Lardner LLP

(57) ABSTRACT

An organizer for a juvenile product is described. The organizer includes a frame including an attachment mechanism configured to attach to a top portion of the juvenile product. The organizer also includes a first compartment mounted to the frame and configured to receive a wet material. A first lid is disposed above the first compartment to move between an open position and a closed position and arranged to cover the first compartment in the closed position. The first lid is configured to seal the wet material within the first compartment when in the closed position. A second compartment of the organizer is configured to receive diaper changing materials, and the second compartment is mounted to the underside of the frame.

32 Claims, 7 Drawing Sheets

ORGANIZER FOR A PLAYARD

FIELD OF THE INVENTION

This invention relates to an organizer that attaches to a juvenile product, such as a playard, bassinet, or crib. More specifically, this invention relates to an organizer that is configured to facilitate the changing of an infant's diaper.

BACKGROUND OF THE INVENTION

Portable playards can include a changing table and bassinet accessories. The changing table and bassinet typically are suspended from the playard. When an infant in a playard, such as a playpen, needs a diaper change, the changing process can be hurried and disorganized. Diaper changing supplies, such as diapers, disposable wet wipes, baby powder, and diaper rash cream may be left by the child caregiver in the area of the playard, either underneath the playard or scattered around the playard, creating a disorganized appearance and a potentially hazardous area where the child plays and the child caregiver walks.

Organizers for a playard are known. For example, U.S. Design Pat. No. 429,929 to Benson illustrates an organizer for a playard. The organizer of Benson mounts to a playard and includes three adjacent open compartments. However, there is a need for an improved organizer for a playard that attaches to the playard and that includes compartments particularly suited to store and organize items needed to change a child's diaper, including wipes and diapers. There is also a need for an organizer that allows one-hand retrieval of the wipes and diapers.

SUMMARY OF THE INVENTION

An aspect of the present invention relates to an organizer for a juvenile product. The organizer comprises a frame including an attachment mechanism configured to attach to a top portion of the juvenile product; a first compartment mounted to the frame and configured to receive a wet material; a first lid disposed above the first compartment to move between an open position and a closed position and arranged to cover the first compartment in the closed position, the first lid being configured to seal the wet material within the first compartment when in the closed position; and a second compartment configured to receive diaper changing materials, the second compartment mounted to the underside of the frame.

Another aspect of the present invention also relates to an organizer for a juvenile product. The organizer comprises a frame including an attachment mechanism configured to attach to a top portion of the juvenile product, the frame extending generally horizontally; a first compartment mounted to the frame; and a second compartment configured to receive diapers and mounted to the frame, wherein the second compartment comprises a compressible material.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

The present inventors have realized that there is a need for an improved organizer for a playard that attaches to the playard and that includes compartments particularly suited to store and organize items needed to change a child's diaper, including wipes and diapers. The present inventors have realized that there is also a need for an organizer that allows one-hand retrieval of the wipes and diapers. These functions allow for simple, less-frustrating diaper changes by a user. In addition, the organizer enables a caregiver to keep the area surrounding and proximate to the playard clean and organized.

Figure 1:
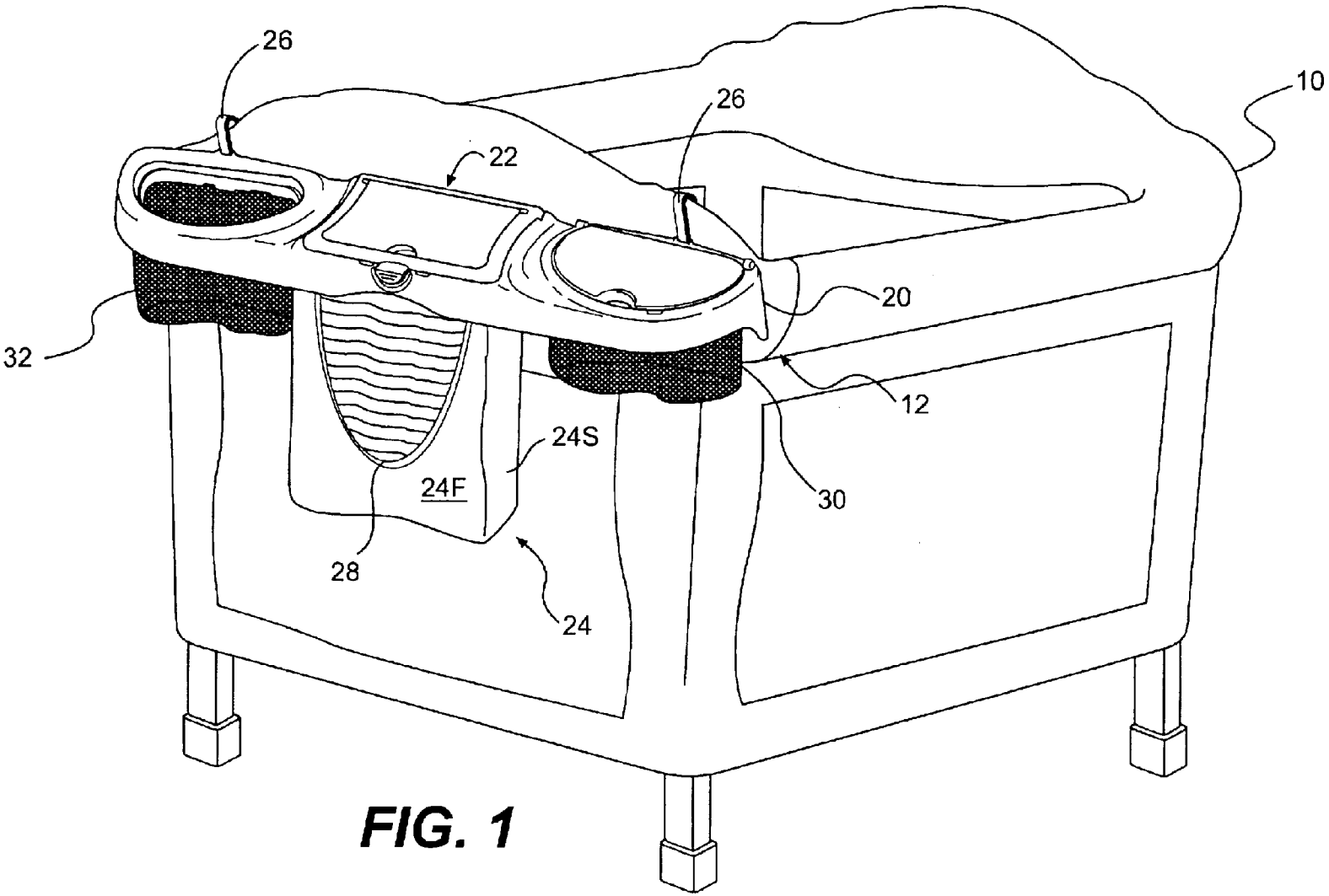
FIG. 1 is a perspective view illustrating an organizer according to an exemplary embodiment of the present invention, where the organizer is attached to a playard.

FIG. 1 illustrates an organizer 12 that can be attached to a juvenile product, such as the playard 10 shown in FIG. 1. The organizer 12 may be attached to either end of the playard 10. The organizer 12 includes a frame 20, a first compartment 22, and a second compartment 24. The frame 20 may comprise a plastic material, such as injection-molded polypropylene, or a metal material, for example.

The frame 20 includes an attachment mechanism 26 that is configured to attach to a top portion of the playard 10. The attachment mechanism 26 may be, for example, a pair of hooks which attach the frame 20 to the top rails of the playard 10. The attachment mechanism may be formed integrally with the frame 20, or it can be formed separately from the frame 20 and then attached to the frame 20 with fasteners.

The first compartment 22 and the second compartment 24 are configured for containing wet material, such as infant wipes, and diaper changing materials, such as diapers, respectively, and thus are convenient for a child diaper changing process. The first compartment 22 may be mounted to the frame 20 by integrally forming the first compartment 22 and the frame 20 as a unitary structure. Alternatively, the first compartment 22 may be removably mounted to the frame 20 by fasteners, such as snaps, hook and loop fastener material, plastic clips, or any other suitable fastener. The second compartment 24 may hang down below the frame 20, and may be configured to hold diapers of various sizes.

The second compartment 24 may comprise a compressible material such as fabric, mesh, nylon, or compressible plastic, for example. The compressible material allows the second compartment 24 to be stored easily. For example, the second compartment 24 can be compressed against the more rigid frame 20 to be stored as a relatively small package. The second compartment 24 may be a fabric bag formed from a poly-nylon blend, such as 75 denier polyester, which is commercially known as 75D poly. The second compartment 24 may be mounted to the underside of the frame 20, as explained in more detail below.

The organizer 12 may also include a third compartment 30 and a fourth compartment 32 for carrying miscellaneous diaper changing products, such as anti-rash ointment and baby powder. The third compartment 30 and the fourth compartment 32 may comprise mesh bags compressible for easy storage.

Figure 2:
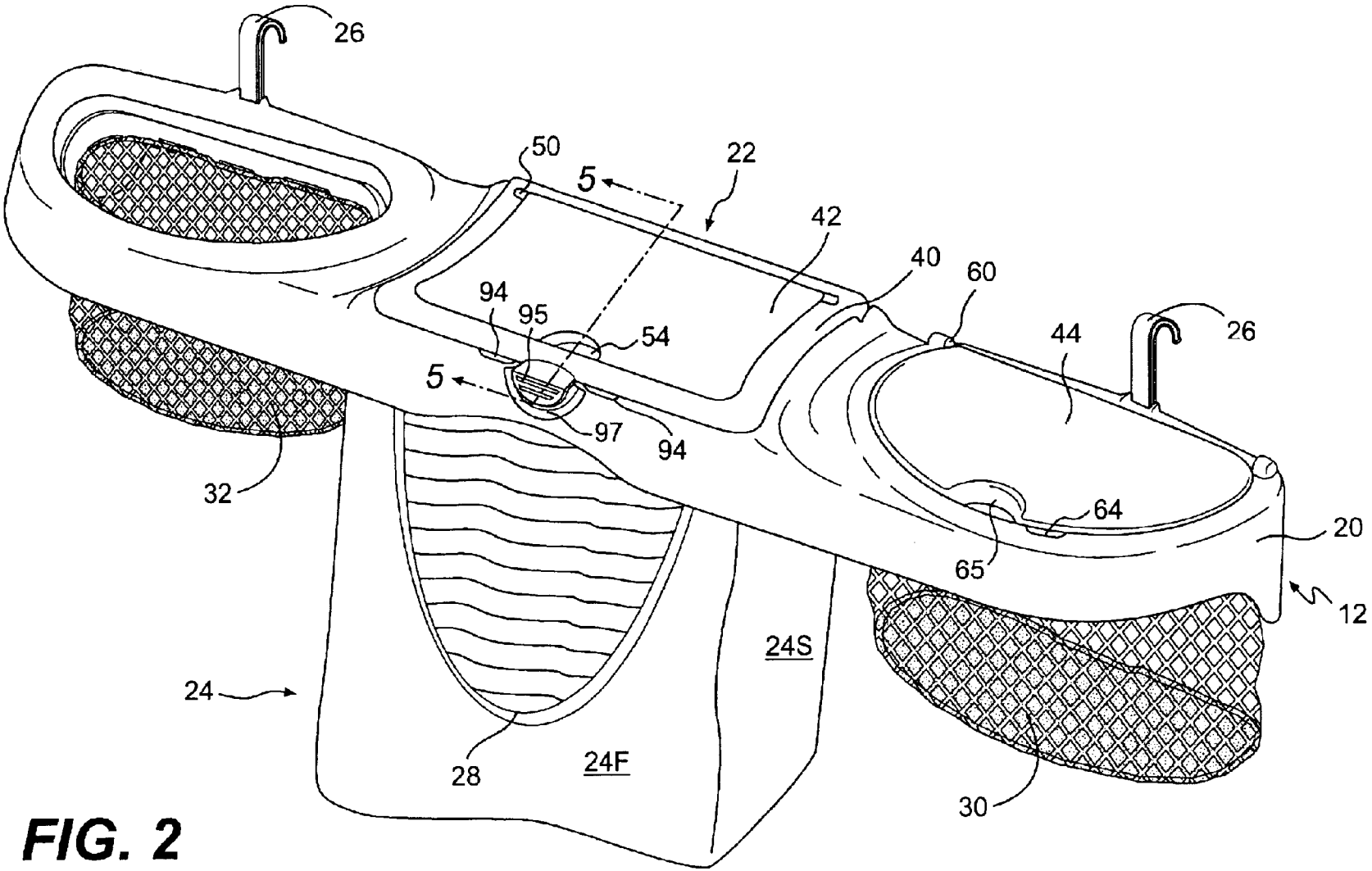
FIG. 2 is a perspective view illustrating the organizer of FIG. 1, with an auxiliary lid, a major lid, and a minor lid in a closed position.
Figure 3:
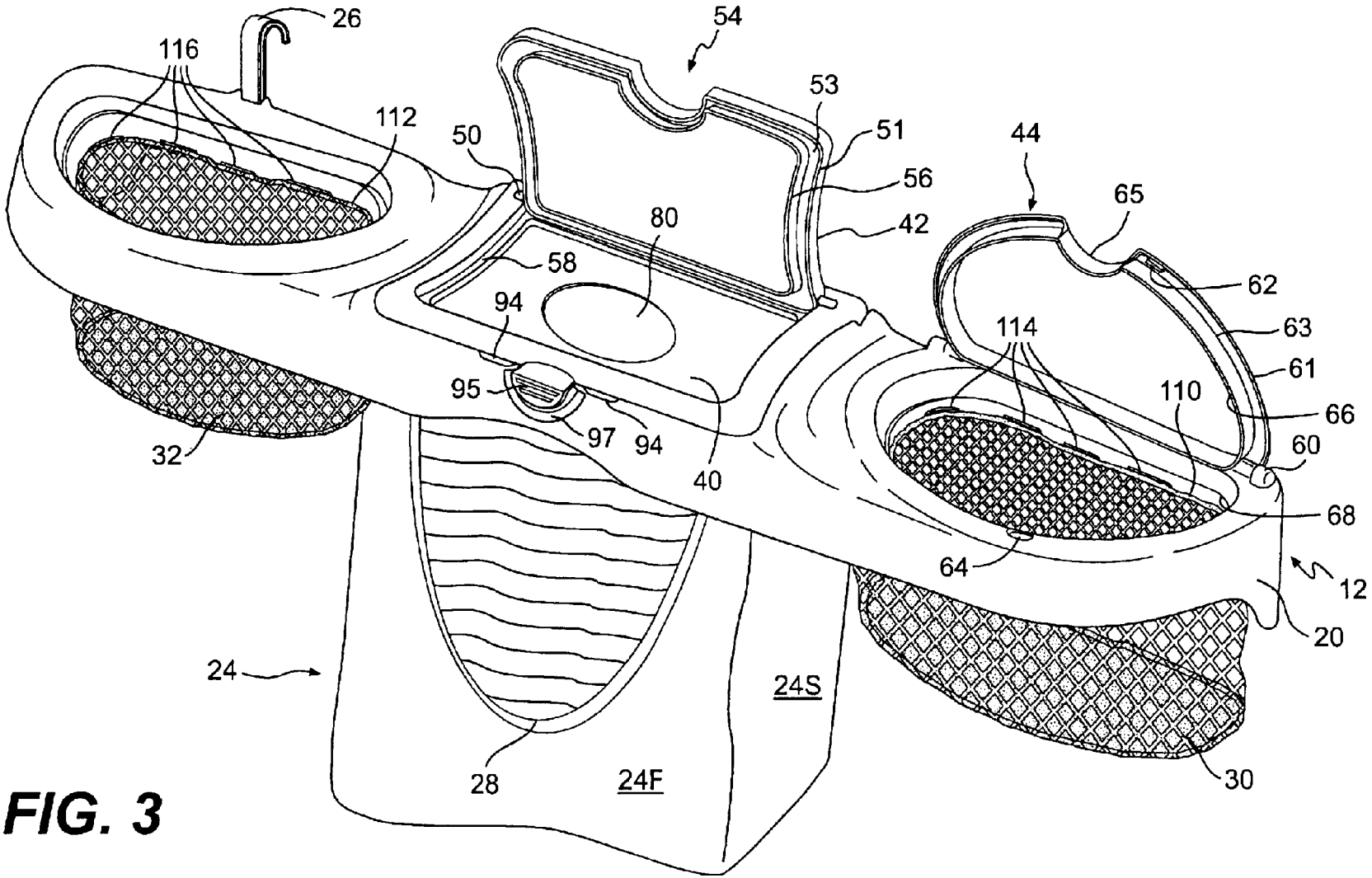
FIG. 3 is a perspective view illustrating the organizer of FIG. 1, with the auxiliary lid and the minor lid in an open position, and the major lid in the closed position.
Figure 4:
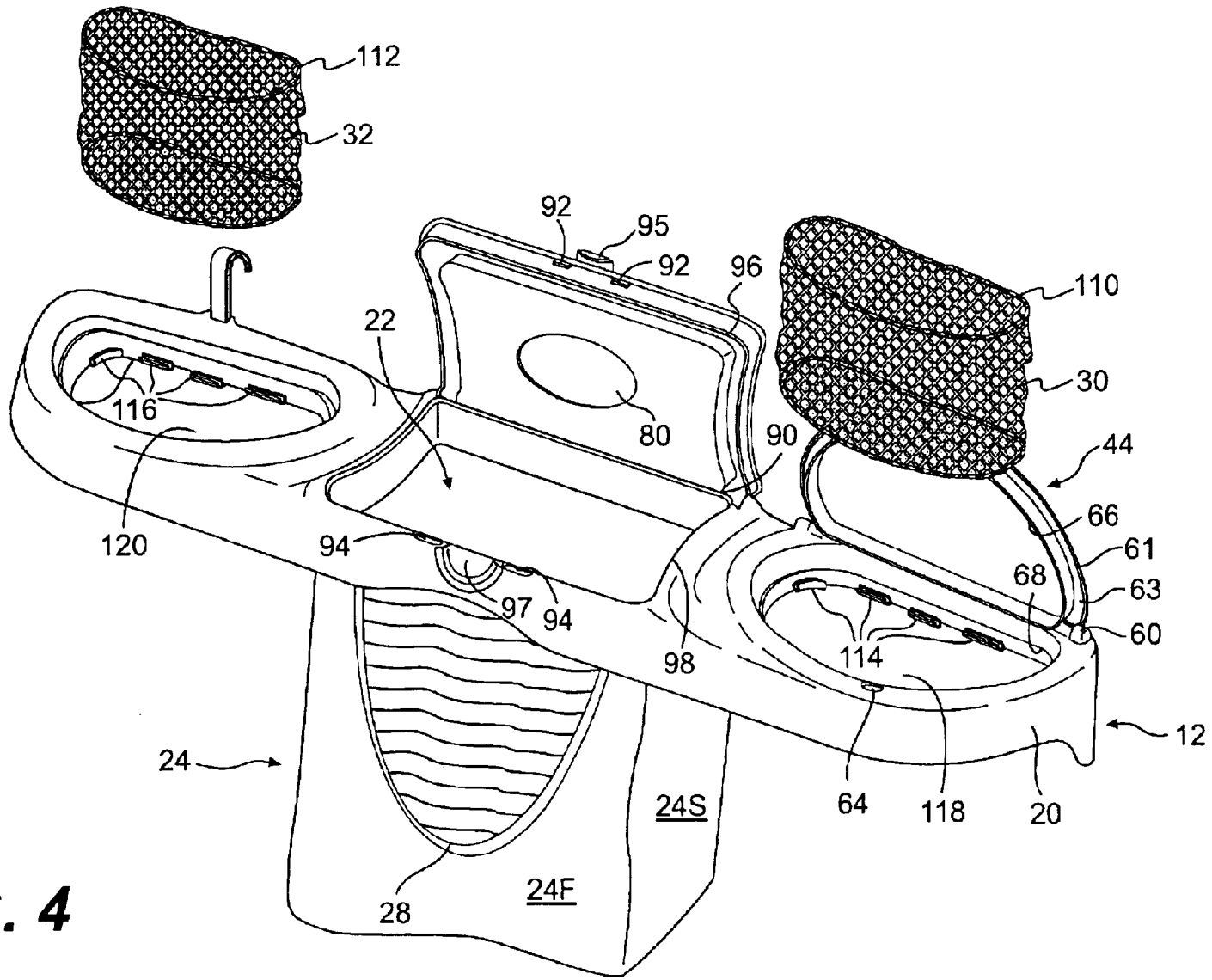
FIG. 4 is a perspective view illustrating the organizer of FIG. 1, with the auxiliary lid, the major lid, and the minor in the open position.
Figure 5:
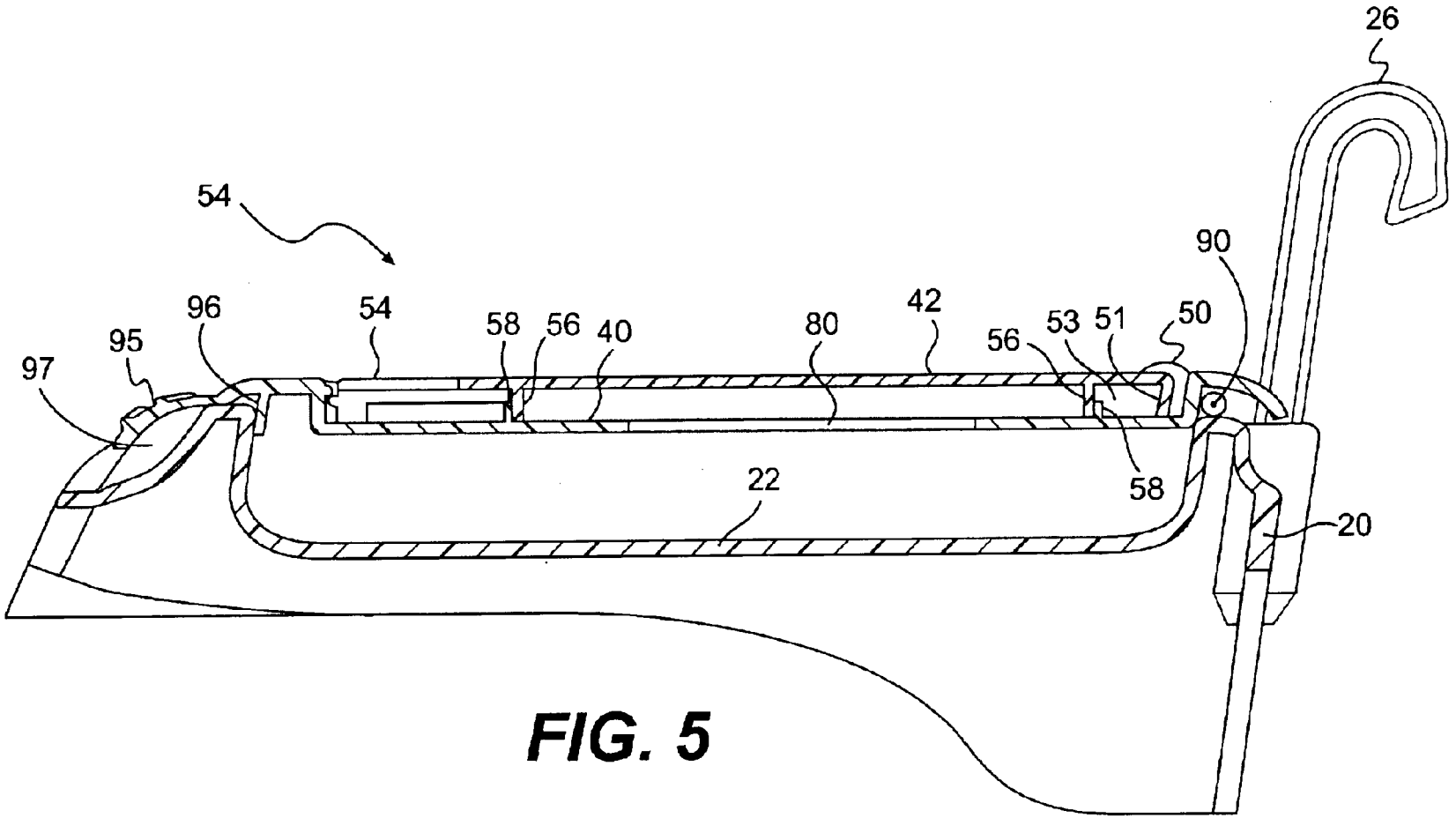
FIG. 5 is a cross-sectional view illustrating a first compartment of the organizer of FIG. 1 with the major lid and the minor lid, as taken along line 5—5 in FIG. 2.

FIGS. 2–4 are perspective views of the organizer of FIG. 1, illustrating a major lid 40 and a minor lid 42 to cover the first compartment 22, and an auxiliary lid 44 to cover the third compartment 30. FIG. 5 is a cross-sectional view illustrating the first compartment 22 of the organizer of FIG. 1 with the major lid 40 and minor lid 42. FIG. 5 illustrates the first compartment 22 integral to the frame 20.

In FIG. 2, the lids 40, 42 and 44 are all arranged in a closed position. FIG. 3 illustrates the organizer of FIG. 1, where the minor lid 42 and the auxiliary lid 44 are open, while the major lid 40 remains closed. The minor lid 42 is attached to the major lid 40 by a hinge 50 which allows the minor lid 42 to pivot open or closed relative to the major lid 40. In another embodiment, the minor lid 42 can be attached to the frame 20 to move between an open position and a closed position relative to the major lid 40. The minor lid 42 may include a front recess 54, which a user may grasp with one hand to open the minor lid 42.

The minor lid 42 includes a downwardly depending rim 51 that extends substantially around the perimeter of the lid 42. The lid 42 also includes a flange 56 that extends downwardly from the lower surface of the lid 42, adjacent the rim 51, to create a recess 53 between the rim 51 and the flange 56. An upper surface of the major lid 40 includes a lip 58 that is received in the recess 53 when the minor lid 42 is closed. Beneficially, when the minor lid 42 is closed, an outboard surface of the flange 56 and an inboard surface of the lip 58 engage and act as a seal, thus preventing wipes within the first compartment 22 from drying out. The seal may be a hermetic seal, for example.

As can be seen in FIG. 3, the major lid 40 includes an aperture 80 configured so that wipes within the first compartment 22 may be removed through the aperture 80 when the major lid 40 is closed and the minor lid 42 is open. The aperture 80 may be of a size to expose only a portion of the top surface of the top wipe within the first compartment 22. A user may grasp the portion of the wipe exposed, and pull it through the aperture 80.

The minor lid 42 may be made of a translucent or transparent material, such as a translucent or transparent plastic, to allow a user to visually inspect beneath the minor lid 42 without opening the minor lid 42. Thus, a user may check to see if the first compartment 22 contains any wipes without opening the minor lid 42.

The auxiliary lid 44 of the third compartment 30 is attached to the frame 20 by a hinge 60, which allows the third lid 44 to pivot open or closed. The auxiliary lid 44 may include latch extending portions 62 which extend and engage with latch receiving portions 64 on the frame 20. In this regard, the latch receiving portions 64 comprise recesses that are engaged by the latch extending portions 62. Further, the auxiliary lid 44 may include a front recess 65, which a user may grasp with one hand to open the auxiliary lid 44.

In a similar fashion to the minor lid 42, the auxiliary lid 44 includes a downwardly depending rim 61 that extends substantially around the perimeter of the lid 44. The lid 44 also includes a flange 66 that extends downwardly from the lower surface of the lid 44, adjacent the rim 61, to create a recess 63 between the rim 61 and the flange 66. An upper surface of the frame 20 includes a lip 68 that is received in the recess 63 when the auxiliary lid 44 is closed. When the auxiliary lid 44 is closed, an outboard surface of the flange 66 and an inboard surface of the lip 68 engage and act as a seal. In this case the third container 30 may comprise a bag, such as a plastic or fabric bag instead of mesh, configured to hold soiled diapers, where the auxiliary lid 44 when closed helps to reduce the odor of the soiled diapers.

FIG. 4 illustrates the organizer of FIG. 1, where the major lid 40, the minor lid 42, and the auxiliary lid 44 are open. The major lid 40 is attached to the frame 20 by a hinge 90, which allows the major lid 40 to pivot open or closed relative to the frame 20. The major lid 40 may include latch extending portions 92 which extend and engage with receiving portions 94 on the frame 20. In this regard, the latch receiving portions 94 comprise recesses that are engaged by the extending portions 92. There may be only a single latch extending portion 92 and a single latch receiving portion 94. Further, the major lid 40 also may include a front tab 95, and the frame may include a front recess 97 configured to receive the front tab 95 when the lid 40 is in the closed position. The major lid 40 can be opened with one hand by lifting the front tab 95 from its engaged position in the front recess 97.

The major lid 40 also includes a peripheral flange 96 extending adjacent the perimeter of the lid 40 from a bottom surface of the lid 40. The peripheral flange 96 can engage an inner side surface 98 of the compartment 22. Beneficially, when the major lid 40 is closed, the peripheral flange 96 and the inner surface 98 engage and act as a seal.

When the major lid 40 is open, the first compartment 22 is exposed and wipe refills may be added to (or removed from) the first compartment 22. The first compartment 22 may be mounted to the frame 20 by integrally molding the first compartment 22 with the frame 20. Alternatively, the first compartment 22 may be configured to be removably mounted to the frame 20. In this latter arrangement, the first compartment 22 may comprise a box or flexible vinyl pouch for containing wipes, where the box or pouch may be attached to the frame 20 when the major lid 40 is open. The first compartment 22 may snap into and out of the frame 20 so as to be convenient for travel.

Preferably, the major lid 40, the minor lid 42 and the auxiliary lid 44 are opened and closed using a latching mechanism, such as the lid extending and receiving portions 92, 62, 94, 64 and the flanges, lips and surfaces 56, 66, 96, 68, 68, 98 described above, that allows a user to open the lids with a single hand. Thus, a user may hold, distract, and/or restrain an infant with one hand, while using only the other hand to open and close the lids. This one hand opening and closing of the lids allows a user to change an infant's diaper with convenience. The major lid 40, the minor lid 42, the auxiliary lid 44, and the frame 20 may all be made of injection-molded polypropylene.

The third compartment 30 and fourth compartment 32 are illustrated in the Figures with and without a lid, respectively. Alternatively, both the third compartment 30 and fourth compartment 32 may include lids, or both may be without lids.

Figure 6:
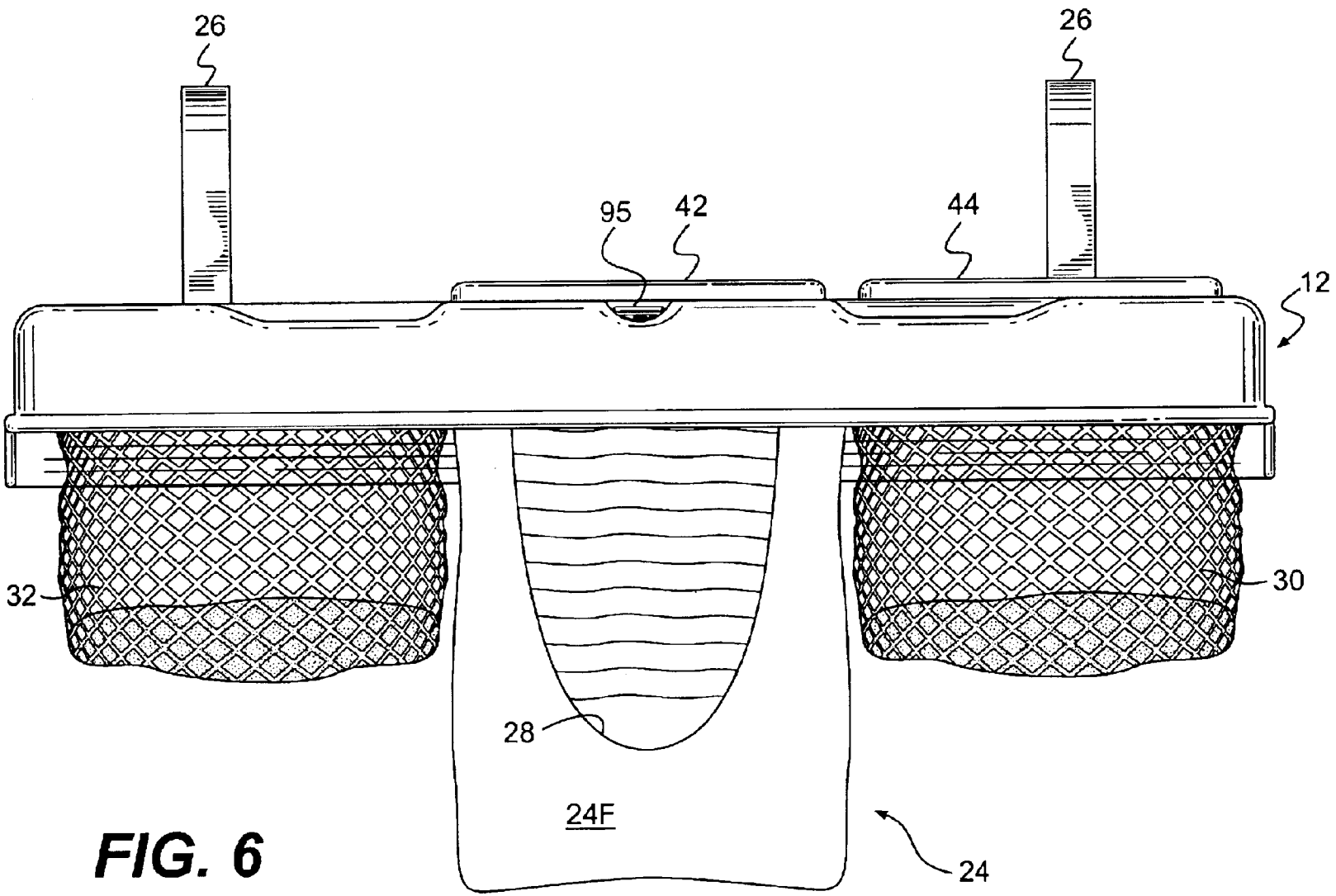
FIG. 6 is a front elevation view illustrating the organizer of FIG. 1.

FIG. 6 is a front view of the organizer of FIG. 1 illustrating an opening 28 configured for removing or adding diapers to the second compartment 24. The second compartment 24 comprises a front panel 24F, opposing side panels 24S, a bottom panel 24B, and a back panel (not shown) opposite the front panel as shown in the Figures. While FIG. 6 illustrates the opening 28 in a front panel 24F of the second compartment 24, the opening 28 could be in either side panel 24S of the second compartment 24. The opening 28 may be a vertically oriented slot, such as a generally U-shaped slot as shown the Figures. Alternatively, the opening 28 may comprise a horizontal slot adjacent a bottom panel 24B (See FIG. 7) of the second compartment 24. As another alternative, the opening 28 may be provided by opening a bottom panel of the second compartment 24. In this case, the second compartment 24 may comprise a front panel, a back panel, and two side panels where the bottom panel is pivotally attached to the back panel and is releasably latched to the front panel.

As another alternative, the second compartment 24 may comprise a bottom panel that is biased upward so that diapers are pushed upward to the top portion of the second compartment 24 as the diapers are removed from the second compartment 24. The bottom panel may be biased by at least one elastic strip, for example, that is attached to a top panel of the second compartment 24 and to the bottom panel 24B. In this alternative, the second compartment 24 may include a top horizontal slit for removing a single diaper from the second compartment 24, rather than the generally U-shaped slot of the Figures.

Figure 7:
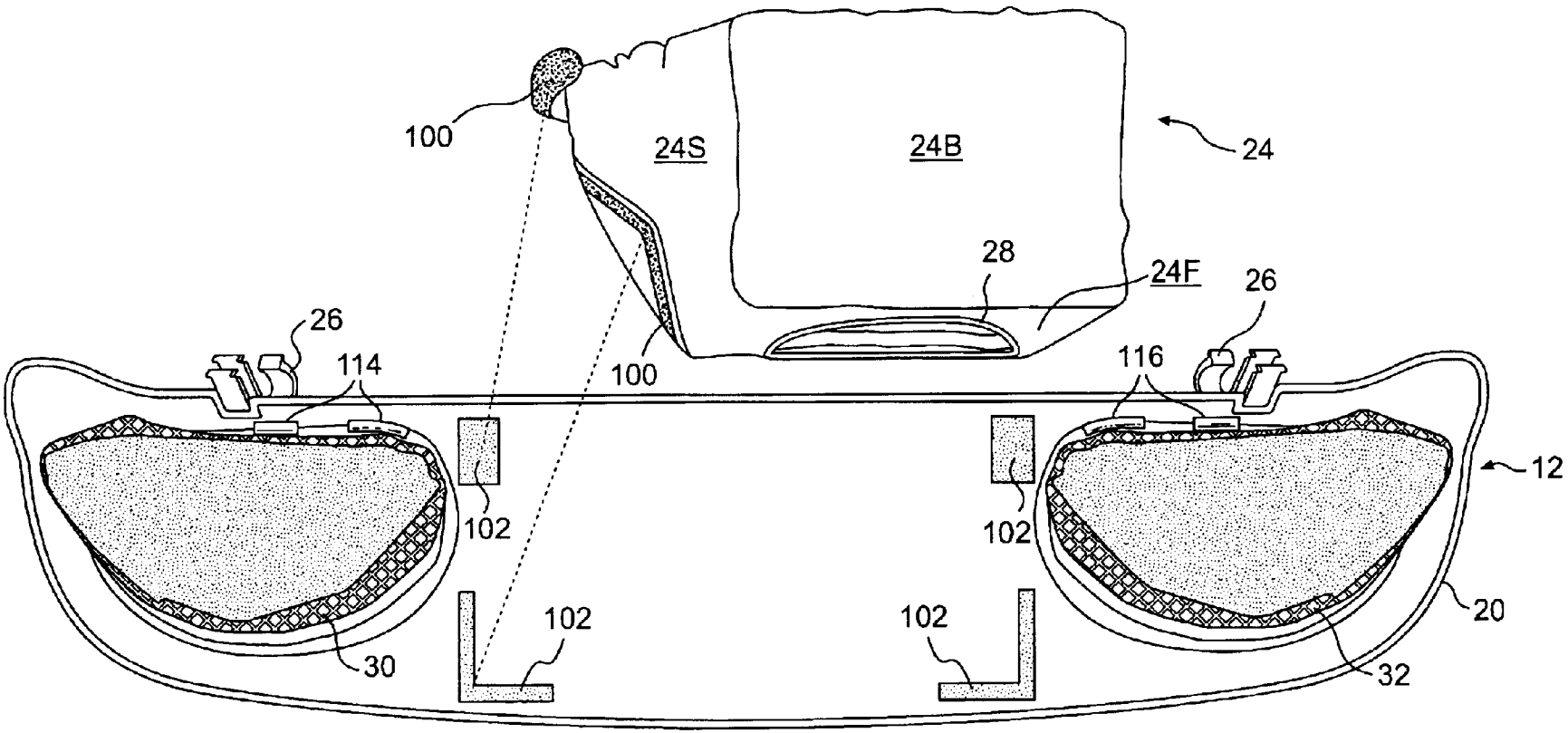
FIG. 7 is a bottom view of the organizer of FIG. 1 illustrating an attachment mechanism to attach a second compartment to the frame of the organizer.

FIG. 7 is a bottom view of the organizer of FIG. 1 illustrating attachment of the second compartment 24 to the frame 20 of the organizer 12. In this regard, the second compartment 24 includes a number of strips of hook and loop fastener material 100 attached to an outer surface of the second compartment 24. For example, the second compartment 24 may include four strips of hook and loop fastener material 100, one strip at each corner of a top portion of the second compartment 24. The strips of hook and loop fastener material 100 on the second compartment 24 mate with corresponding strips of hook and loop fastener material 102 mounted to the underside of the frame 20. In this regard, strips 100 of hook and loop fastener material may include hook type fastener material, and the corresponding strips 102 may include loop type fastener material, or vice-versa. The strips 100, 102 may be of any shape sufficient to retain the second compartment 24 on the frame 20. The number of strips 100, 102 may be four each, for example, but can be any number sufficient to retain the second compartment 24 on the frame 20.

The hook and loop fastener strips 100, 102 allow the second compartment 24, which may comprise a fabric bag, to be easily attached to and detached from the frame 20. Additionally, should a small child or an infant attempt to pull up on the second compartment 24, for example to climb into the playard 10 (see FIG. 1), the second compartment 24 will easily detach from the frame 20. In one embodiment, the second compartment 24 may detach for a load in excess of ten pounds.

As an alternative to strips of hook and loop fastener material, the organizer 12 may include a number of pressure sensitive strips that allow the second compartment 24 to easily attach to and detach from the frame 20. As another alternative, the organizer 12 may be attached to the frame 20 via screws, snaps, or any other suitable fastener.

FIGS. 3 and 4 also illustrate a structure for attachment of the third compartment 30 and the fourth compartment 32 to the frame 20. The third and fourth compartments 30 and 32 may each comprise a mesh pocket, for example. Rings 110, 112 may be sewn into an upper portion of the third and fourth compartments 30, 32, respectively. The rings 110, 112 engage with corresponding flanges 114, 116 peripherally arranged in corresponding frame apertures 118, 120 to mount the third compartment and fourth compartments 30, 32 to the frame 20. When the first compartment 22 comprises a flexible vinyl pouch, the first compartment 22 also may be attached to the frame 20 via a ring and flange attachment arrangement.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. An organizer for a juvenile product, comprising:

a frame including an attachment mechanism configured to attach to a top portion of the juvenile product;

a first compartment mounted to the frame and configured to receive a wet material;

a first lid disposed above the first compartment to move between an open position and a closed position and arranged to cover the first compartment in the closed position, the first lid being configured to seal the wet material within the first compartment when in the closed position; and a second compartment configured to receive diaper changing materials, the second compartment mounted to the underside of the frame.

2. The organizer of claim 1, wherein the second compartment is arranged directly below the first compartment.

3. The organizer of claim 1, wherein the attachment mechanism comprises a pair of hooks for attaching to a top rail of the juvenile product.

4. The organizer of claim 1, wherein the first compartment is integrally molded to the frame.

5. The organizer of claim 1, further comprising:

a second lid having an aperture and being movably mounted to the frame between an open position and a closed position, the second lid being disposed between the first compartment and the first lid so that, when the first lid is in the open position and the second lid is in the closed position, wet material disposed within the first compartment may be removed through the aperture.

6. The organizer of claim 5, wherein the first lid and the second lid are configured to be opened with one hand.

7. The organizer of claim 6, wherein the first lid comprises a tab and the frame comprises a recess, the recess configured to receive the tab when the first lid is in the closed position.

8. The organizer of claim 6, wherein the second lid comprises a recess configured to allow a user to grasp and open the second lid.

9. The organizer of claim 5, wherein the first lid is formed of at least one of a translucent material and a transparent material.

10. The organizer of claim 5, wherein the first lid, when in a closed position, forms a first seal with at least one of the frame and the second lid, and the second lid, when in a closed position, forms a second seal with the frame.

11. The organizer of claim 1, wherein the first compartment is configured to be removable from the frame.

12. The organizer of claim 1, wherein the second compartment includes an opening configured for removing or adding diapers to the second compartment.

13. The organizer of claim 12, wherein the opening comprises a vertical slot.

14. The organizer of claim 1, wherein the second compartment includes at least one hook and loop fastener strip and the frame includes a mating hook and loop fastener strip to attach the second compartment to the frame.

15. The organizer of claim 14, wherein the mating hook and loop fastener strip is mounted to the underside of the frame.

16. The organizer of claim 1, further comprising:

a third compartment mounted to the frame.

17. The organizer of claim 16, further comprising:

an auxiliary lid movably mounted to the frame and arranged to cover the third compartment.

18. The organizer of claim 17, wherein the auxiliary lid is configured to be opened with one hand.

19. The organizer of claim 16, wherein the third compartment comprises a fabric pocket.

20. The organizer of claim 19, wherein the fabric pocket includes a ring, and the frame includes at least one flange, the at least one flange engaging the ring to mount the third compartment to the frame.

21. The organizer of claim 16, further comprising:

a fourth compartment mounted to the frame.

22. The organizer of claim 21, wherein the fourth compartment comprises a mesh pocket.

23. The organizer of claim 21, wherein the mesh pocket includes a ring, and the frame includes at least one flange, the at least one flange engaging the ring to mount the fourth compartment to the frame.

24. The organizer of claim 12, wherein the second compartment includes a back panel, at least two side panels, a front panel, and a bottom panel, and wherein the opening comprises is generally U-shaped in the front panel, adjacent the bottom panel.

25. An organizer for a juvenile product, comprising:

a frame including an attachment mechanism configured to attach to the juvenile product;

a first compartment mounted to the frame; and a second compartment configured to receive diapers and mounted to the frame, wherein the second compartment is arranged directly below the first compartment, and wherein, when the frame is attached to the juvenile product, the second compartment hangs down below an underside of the frame.

26. An organizer for a juvenile product, comprising:

a frame including an attachment mechanism configured to attach to a top portion of the juvenile product;

a first compartment mounted to the frame; and a second compartment configured to receive diapers and mounted to the frame, wherein the second compartment comprises a compressible material, and wherein the first compartment is integrally molded to the frame.

27. An organizer for a juvenile product, comprising:

a frame including an attachment mechanism configured to attach to the juvenile product;

a first compartment mounted to the frame; and a second compartment configured to receive diapers and mounted to the frame, wherein, when the frame is attached to the juvenile product, the second compartment hangs down below an underside of the frame, and wherein the second compartment includes an opening configured for removing or adding diapers to the second compartment.

28. An organizer for a juvenile product, comprising:

a frame including an attachment mechanism configured to attach to a top portion of the juvenile product;

a first compartment mounted to the frame; and a second compartment configured to receive diapers and mounted to the frame, wherein the second compartment comprises a compressible material, wherein the second compartment includes an opening configured for removing or adding diapers to the second compartment, and wherein the opening comprises a vertical slot.

29. An organizer for a juvenile product, comprising:

a frame including an attachment mechanism configured to attach to a top portion of the juvenile product;

a first compartment mounted to the frame; and a second compartment configured to receive diapers and mounted to the frame, wherein the second compartment comprises a compressible material, and wherein the second compartment includes at least one hook and loop fastener strip and the frame includes a mating hook and loop fastener strip to attach the second compartment to the frame.

30. The organizer of claim 29, wherein the mating hook and loop fastener strip is mounted to the underside of the frame.

31. An organizer for a juvenile product, comprising:

a frame including an attachment mechanism configured to attach to a top portion of the juvenile product;

a first compartment mounted to the frame; and a second compartment configured to receive diapers and mounted to the frame, wherein the second compartment comprises a compressible material, wherein the second compartment includes a back panel, at least two side panels, a front panel, a bottom panel, and an opening, and wherein the opening is generally U-shaped in the front panel, adjacent the bottom panel.

32. An organizer for a juvenile product, comprising:

a frame including an attachment mechanism configured to attach to a top portion of the juvenile product;

a first compartment mounted to the frame; and a second compartment configured to receive diapers and mounted to the frame, wherein the second compartment comprises a compressible material, and wherein the second compartment is mounted to the underside of the frame.

* * * * *